US006687919B2

(12) United States Patent
Dilworth, Jr. et al.

(10) Patent No.: US 6,687,919 B2
(45) Date of Patent: Feb. 10, 2004

(54) MEDICAL GARMENT WITH FLUID BARRIER

(75) Inventors: Curtis Dilworth, Jr., Atlanta, GA (US); Daniel Raiford, College Park, GA (US)

(73) Assignee: Gocurda, LLC, Suwanee, GA (US)

( * ) Notice: Subject to any disclaimer, the term of this patent is extended or adjusted under 35 U.S.C. 154(b) by 184 days.

(21) Appl. No.: 10/047,287

(22) Filed: Jan. 14, 2002

(65) Prior Publication Data

US 2003/0131401 A1 Jul. 17, 2003

Related U.S. Application Data

(63) Continuation-in-part of application No. 09/536,658, filed on Mar. 28, 2000, now Pat. No. 6,460,198, and a continuation-in-part of application No. 29/123,820, filed on May 25, 2000, now Pat. No. Des. 456,112.

(51) Int. Cl.[7] ..... A41D 13/00

(52) U.S. Cl. ..... 2/457; 2/901; 2/84; 2/246; 2/249

(58) Field of Search ..... 2/84, 901, 51, 2/246, 244, 457, 456, 247, 249, 250, 79, 83, 94, 115, 424, 106, 69, 202; 128/201.29, 201.23, 202.19, 206.28

(56) References Cited

U.S. PATENT DOCUMENTS

| | | | | | |
|---|---|---|---|---|---|
| 2,383,261 | A | | 8/1945 | Kronhaus | 2/2.17 |
| 3,015,107 | A | | 1/1962 | Lippman | |
| 3,359,567 | A | * | 12/1967 | Zemme et al. | 2/457 |
| 3,423,763 | A | | 1/1969 | Schwartz | |
| 3,688,314 | A | | 9/1972 | Hill | 2/457 |
| 4,791,681 | A | | 12/1988 | Dean | |
| 4,901,370 | A | * | 2/1990 | Suda | 2/457 |
| 4,932,078 | A | | 6/1990 | Jones et al. | |
| 4,969,214 | A | * | 11/1990 | Cohen | 2/94 |
| 5,005,216 | A | * | 4/1991 | Blackburn et al. | 2/79 |
| 5,142,704 | A | * | 9/1992 | Viemeister et al. | 2/202 |
| 5,357,635 | A | * | 10/1994 | Lemoine | 2/84 |
| 5,411,017 | A | | 5/1995 | Wong | |
| 5,588,154 | A | * | 12/1996 | Blauer et al. | 2/69 |
| 5,628,065 | A | * | 5/1997 | Austin | 2/81 |
| 5,918,314 | A | * | 7/1999 | Moses | 2/79 |
| 5,924,131 | A | * | 7/1999 | Wilkinson | 2/69 |
| 5,991,921 | A | * | 11/1999 | Saito | 2/69 |
| 6,263,509 | B1 | * | 7/2001 | Bowen | 2/69 |
| 6,477,712 | B1 | * | 11/2002 | Jones | 2/69 |

FOREIGN PATENT DOCUMENTS

| | | |
|---|---|---|
| WO | WO 89/08994 | 10/1989 |

* cited by examiner

*Primary Examiner*—A. Vanatta
(74) *Attorney, Agent, or Firm*—Jason A. Bernstein; Powell, Goldstein, Frazer & Murphy, LLP

(57) ABSTRACT

A garment system for healthcare providers including pants, a shirt, and a hood that provides a protective barrier against fluid or airborne contaminates. The pants have drawstrings and loops at the waist and have at least one bellows pocket with cover flap and at least one utility loop for holding various items. The shirt has a one pocket adapted to hold a writing utensil and incorporates a security badge attachment loop. Another pocket has a pull tab on the flap for easy access when the user is gloved. Removable insignia enable the user to remove personal identification information prior to laundering. The hood removably fastens to the shirt collar and has a clear or translucent face shield to permit viewing but be a fluid barrier, and, side openings to permit sound and air to pass into the hood. The shirt can be long or short sleeve, or convertible.

1 Claim, 6 Drawing Sheets

MEDICAL GARMENT WITH FLUID BARRIER

CROSS-REFERENCE TO RELATED APPLICATIONS

This application claims benefit of and is a continuation-in-part of U.S. application Ser. No. 09/536,658, filed Mar. 28, 2000, entitled "BARRIER GARMENT SYSTEM", now U.S. Pat. No. 6,460,198, and U.S. application Ser. No. 29,123,820, filed May 25, 2000, entitled "MEDICAL GARMENT", now U.S. Pat. No. D456,112 the disclosures of which are incorporated in their entirety herein by reference.

FIELD OF THE INVENTION

The present invention relates generally to apparel for healthcare providers and, more particularly, to barrier garments for healthcare provider personnel who work in a field environment and/or in uniformed organizations such as the military.

BACKGROUND OF THE INVENTION

In hospitals, clinics, and the like in the United States, healthcare providers such as physicians, dentists, veterinarians, nurses, paramedics, ancillary healthcare personnel, and the like are required by the Occupational Safety and Health Administration (OSHA) of the U.S. Department of Labor to wear barrier garments such as gowns or scrubs. These barrier garments are required to prevent the healthcare provider from being exposed to potentially infectious material in body fluids from the patients they treat, and vice versa. Additionally, OSHA requirements do not permit healthcare providers to practice in the same clothes that they wear when not practicing. Clothing used as barrier garments are not allowed to come into contact with the general public outside the use area. The barrier garments must therefore generally be taken off immediately after a single use and laundered or discarded.

These requirements are necessary to prevent the exposure of other persons to potentially infectious materials such as hepatitis B, Acquired Immune Deficiency Syndrome (AIDS), and other blood borne pathogens in body fluids such as blood, saliva, and other oral and respiratory fluids. These OSHA requirements are provided at least in part in *Occupational Exposure to Bloodborne Pathogens; Final Rule,* 29 C.F.R. Part 1910.1030 (Dec. 6, 1991), and in *Controlling Occupational Exposure to Bloodborne Pathogens in Dentistry*, published as OSHA 3129 by the U.S. Department of Labor in 1992.

However, healthcare providers in uniformed organizations such as the U.S. military branches, paramedics, "Flying Doctors of America," United Nations healthcare providers, humanitarian organizations, "Doctors Without Borders," other internationally serving healthcare providers, and the like that practice in countries other that the U.S. and/or that practice in the field or in combat situations are required by such organizations to wear apparel approved by and consistent with the uniform requirements of the organizations. For example, healthcare providers in the military are required to always wear "Battle Dress Uniforms" (BDUs) in accordance with uniform protocol, which BDUs do not provide protection from potentially infectious materials in body fluids. As a result, healthcare providers in these situations often practice in the same clothing in which they eat, socialize, and sometimes sleep. As their BDUs are often splattered with blood and other body fluids after providing field and combat treatment, there is significantly increased the exposure to themselves and others of infectious materials.

Accordingly, what is needed but not found in the prior art is a garment for healthcare providers that provides a protective barrier against infectious materials in body fluids and that is adapted for use in uniformed organizations such as the military and that is capable of being re-sterilized or throw away.

SUMMARY OF THE INVENTION

Accordingly, the present invention overcomes the deficiencies of the prior art by providing a garment system for healthcare providers that provides a protective barrier against infectious materials in body fluids, semi-fluids, and aerosols, and is adapted for use in uniformed organizations such as the military. Generally described, the present invention comprises pants or other means for substantially covering a person's lower body, a shirt or other means for substantially covering a person' upper body, and a hood or other means for substantially covering a person's head. The pants, shirt and hood form a generally contiguous barrier protecting the wearer from infectious materials in body fluids. The garments may have a pattern in compliance with uniform requirements of an organization, such as camouflage for the military or indicia printed thereon.

The pants may have leg bottoms that can be cinched by any of various means at the ankles and tucked into a wearer's boots, a variety of size and arrangement of pockets, and a waistband with a drawstring and/or or belt loops. The shirt may have short, medium, or long arm sleeves with ends that can be cinched by any of various means at the wrists, a bottom section that overlaps with the pants waist, and a variety of size and arrangement of pockets. The shirt may also have organizational insignia such as "U.S. Army" or a unit crest sewn or otherwise fixedly attached to the shirt, and personal insignia such as the wearer's name and rank removably attached to the shirt by hook and loop fasteners, pins, snaps, buttons, or the like. The personal insignia may thus be removed from the shirt which allows for bulk laundering of the garments, for example, laundering of an entire military medical unit's apparel, and redistribution of the garments by size requests from the unit members without having to sort the garments by name.

The hood may have a generally translucent face shield made of a generally flexible material, such as a clear plastic. One or more openings may be provided in the hood for ventilation and sound transmission. One or more couplings, such as hook and loop fasteners, may be provided for detachably connecting the hood to the shirt, so that the hood can be detached from the shirt and, for example, stored in one of the pants or shirt pockets.

These and other features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF ONE EMBODIMENT OF THE INVENTION

Figure 1:
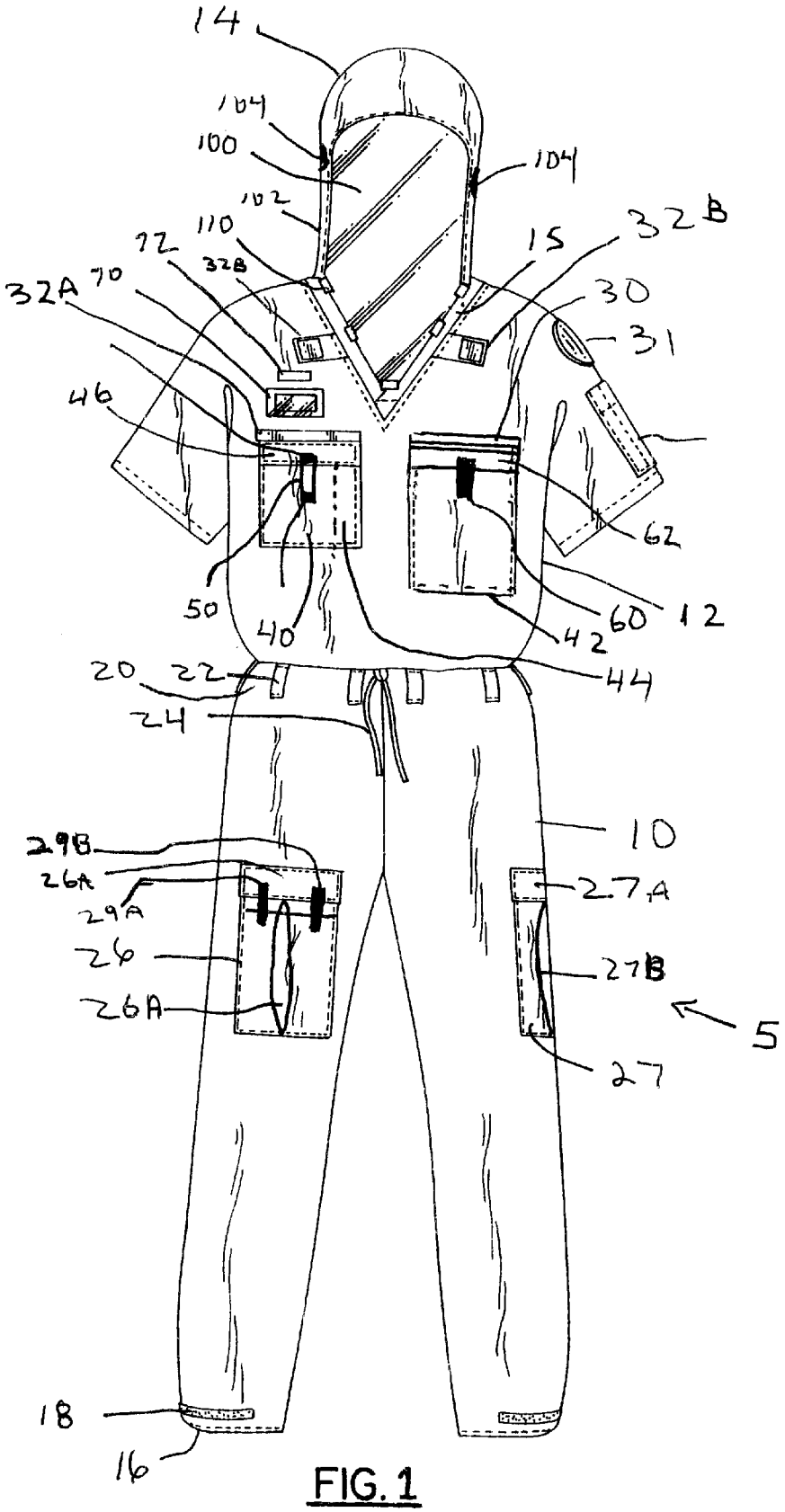
FIG. 1 is a front view of the pants of a preferred embodiment of the present garment system invention.

Referring now to FIG. 1, there is illustrated one preferred embodiment of a garment 5, having pants 10, a shirt 12, and a hood 14, each made of material such as a cloth, a synthetic fabric, paper or paper-like material for single use garment applications, or another known material that may act as a barrier to fluids. The material may be selected for durability and laundering to provide for reuse of the garments or for lower cost to provide for disposal after a single use. Many suitable single layer and laminate materials have been developed which act as fluid barriers and which provide for ventilation and comfort, such as, but not limited to, those fabrics available from Kimberly-Clark Corporation, Neenah, Wis.

It will be understood by those skilled in the art that the garments can be provided by the component parts of pants 10, the shirt 12, and the hood 14 combined, that each component 10, 12, and 14 can be provided and used individually and/or in conjunction with other garments, that the garments can be provided specifically for use by men, women, or both, and that the garments can be provided by a unitary garment such as a jumpsuit, gown, robe, dress, or the like. When used in conjunction with gloves and boots or the like, the garment system provides full body protection to the wearer from exposure to infectious material in body fluids. Also, the pants 10, shirt 12, and hood 14 may be worn over conventional uniforms, undergarments, or other garments, or may be worn alone.

The pants 10, shirt 12, and hood 14 may have a surface pattern or design confirming to the uniform requirements of an organization. Such patterns may include camouflage, United Nations blue, Desert Storm sand color, khaki, and/or the like. The garments may thus be worn as a uniform in compliance with organizational requirements while also providing the wearer protection against infectious materials in body fluids.

Figure 2:
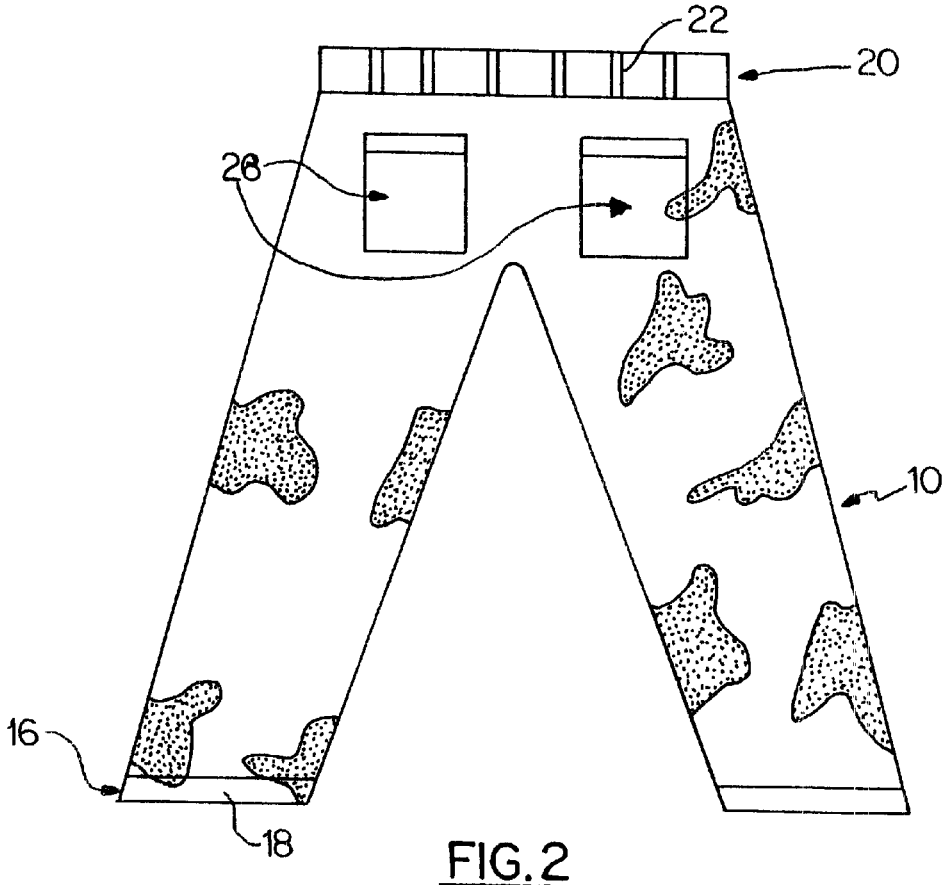
FIG. 2 is a rear view of the pants of FIG. 1.

The pants 10 (shown in FIGS. 1 and 2) may be provided in sizes such as small, medium, large, and the like for corresponding to a wearer's lower body size. The pants 10 may have an elongated and optionally narrowed bottom section 16 for tucking into the wearer's boots or the like. The bottom section 16 may have a strap 18 or the like with a buckle, snap, hook and loop fasteners, or the like for adjustably conforming the bottom section 16 to the wearer's ankles to prevent fluids from contacting the wearer. The pants 10 have a waist 20 with optional belt loops 22 for receiving therethrough a conventional belt. Optionally, the waist 20 can have a drawstring 24 associated therewith for tightening of the waist, or the waist 20 can have an elastic waistband, or other waistbands known to those skilled in the art. Additionally, the pants 10 may have at least one pocket 26. In a preferred embodiment, the pants 10 have a front pocket 26 (shown with optional flap cover 26A), a side pocket 27 (shown with optional flap 27A) and optionally one or more rear pockets 28 which may optionally have cover flaps 28A. It will be understood by those skilled in the art that the pants 10 can be provided by any means for substantially covering a wearer's lower body, including a skirt, shorts, jumpsuit, gown, robe, dress, or the like. The pockets 27 and 27 (and optionally 28) can be constructed so as to be "bellowed" as is known to those skilled in the art to provide increased storage area, as noted in pocket 26 as bellows 29 and in pocket 27 as bellows 27B. The pocket 26 may have one or more utility loops 29A and 29B, which can be used to hang scissors, tools, or the like, for easier access by a user.

The shirt 12 may be provided in sizes such as small, medium, large, extra-large, and the like for corresponding to a wearer's upper body size. The shirt may have a V-neck 15 (as shown) or round collar. The shirt 12 may have organizational insignia 30 such as the name of the organization (e.g., "U.S. Army"), a unit crest 31 (such as, but not limited to, insignia for a medical group of the organization), or other organizational insignia removably, or, fixedly attached to the shirt by sewing or other attachment methods known to those skilled in the art. Also, the shirt 12 may have personal insignia 32 such as the wearer's name 32A and rank 32B removably attached to the shirt 12 by hook and loop fasteners, snaps, buttons, zippers, or other removable attachment mechanisms known to those skilled in the art. The personal insignia 32 can thus be removed from the shirt 12 after use and a plurality of shirts 12, pants 10, and hoods 14 worn by various personnel can be laundered in bulk and redistributed according to size requests from the healthcare providers without having to sort the garments by the providers' names.

Figure 3:
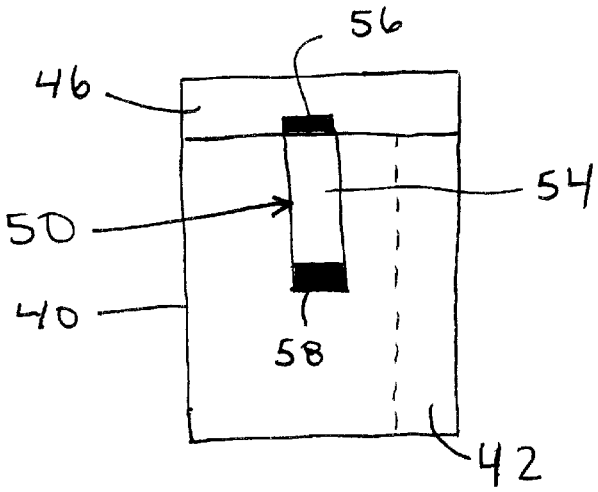
FIG. 3 is a front view of a pocket on the shirt of FIG. 1.
Figure 4:
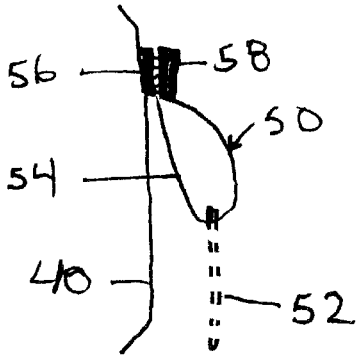
FIG. 4 is a side view of a pocket on the shirt of FIG. 1.
Figure 5:
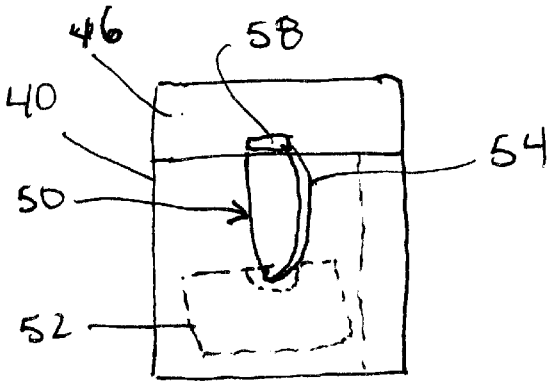
FIG. 5 is a front view of a pocket on the shirt of FIG. 1 with a badge attached

As shown in greater detail in FIGS. 3–5, The front pockets 40 and 42 are shown with the right pocket 40 being smaller than the left pocket 42. It is to be understood that the pockets can be the same size or different sizes, with the larger being on either side. Pocket 40 can be bellowed, pleated or flat and preferably has an area sectioned off by stitching (shown in dashed lines in FIG. 1) as a writing utensil pocket 44 (which alternatively could hold other items, such as, but not limited to a thermometer, dentist's mirror, pen-flashlight, or the like). The pocket 40 preferably has a flap 46 to protect the contents of the pocket 40 from falling out if the user bends over. The pocket preferably has a badge attachment device 50, which can hold an identification badge 52, shown in phantom in FIGS. 4 and 5, other small item (such as, but not limited to, a whistle, flashlight, or the like). The attachment device 50 comprises a loop of fabric 54, or other flexible material, having at one end a first attachment means 56 and at the other end a second attachment means 58. In preferred embodiment, means 56 and 58 are male and female hook and loop fastener material. Alternatively, snaps, buttons, catches or the like can be use. Hook and loop fasteners are preferable because the launder well and remain attached after numerous washing. Also, they do not rust, do not cause damage to dryers, and are not detected by metal detectors. One attachment end of the attachment device 50 is fixedly attached to the pocket 40, preferably to the flap 46. When in use, one end 56 of the attachment device 50 is inserted into a slot in the badge 52 and then looped and attached to the other end 58.

Pocket 42 may be bellowed, pleated or flat and preferably has a pull tab 60 on a flap 62 to facilitate opening the flap if gloves are worn by the user.

Additionally, there may optionally be provided a generally translucent sheet 70 of a material such as plastic or another known material attached to the shirt 12 by sewing or other known methods. At least one side of the translucent sheet 70 is open for removably receiving between the sheet 70 and the shirt 12 a name badge or the like therein so that the badge can be viewed through the translucent sheet 33. Furthermore, a strip 72 of a material such as a fabric, plastic, or other known material may be attached to the shirt 12 by sewing or other known methods. For example, the ends of the strip 72 can attached to the shirt 12 so that a middle portion of the strip 72 is available for easy attachment and detachment thereto by a clip of a conventional clip-on name badge or the like. The translucent sheet 70 and/or the strip 72 thus provide for easily attaching and detaching a name badge or the like to the shirt 12 for organizations where proper identification, security clearances, and the like may be required. The sheet 70 and/or strip 72 may be advantageously positioned on the front chest portion of the shirt 12, for example, above a chest pocket where name badges are commonly worn, for easy viewing thereof.

Figure 6:
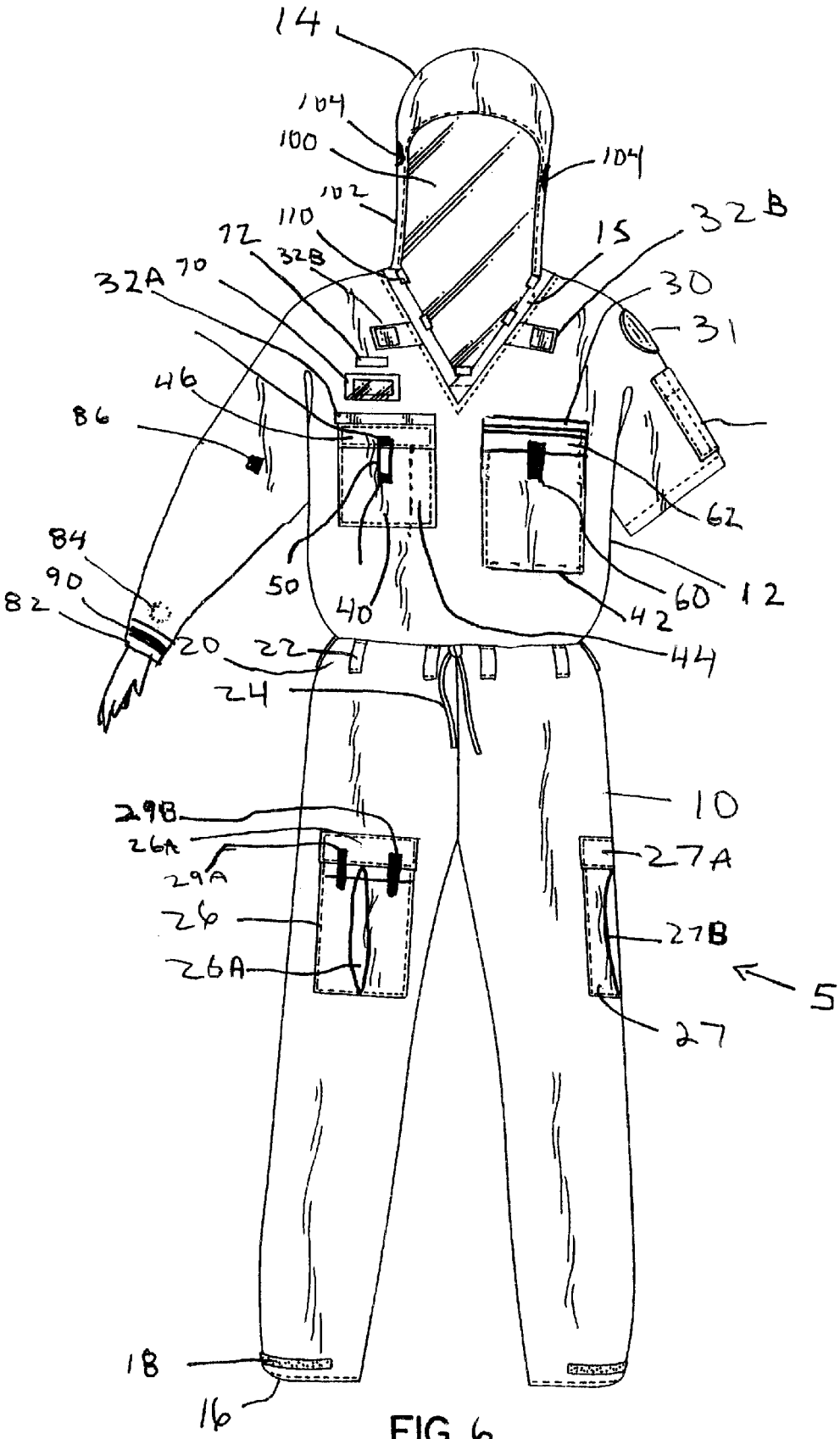
FIG. 6 is an front view of an alternative embodiment of the present invention having long sleeves on the shirt.
Figure 7:
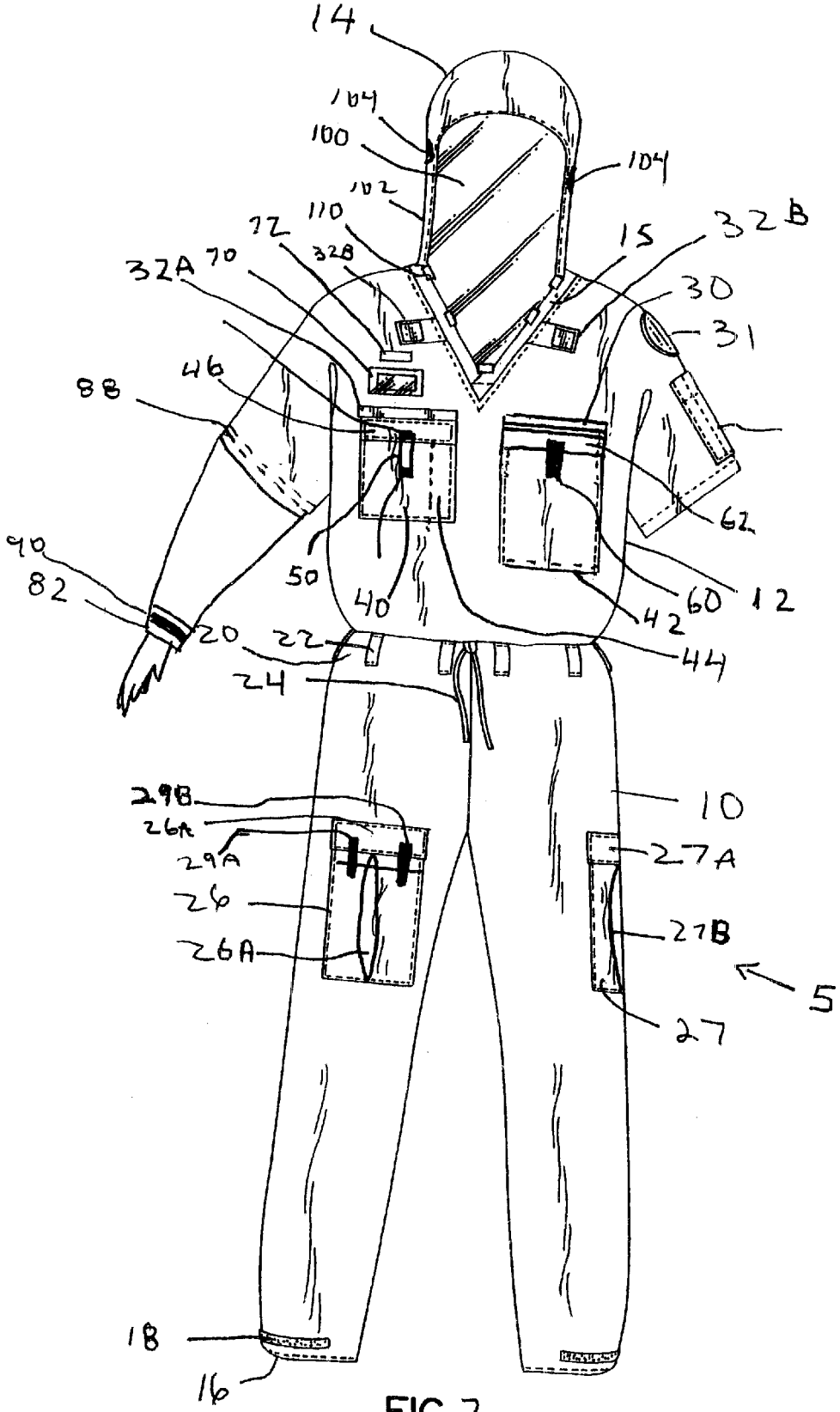
FIG. 7 is an front view of an alternative embodiment of the present invention having a long sleeved shirt that can detach to become a short sleeved shirt.

The shirt 12 may also have an elongated bottom section 74 (not shown), for example, about an extra two inches of length, for overlapping with the pants waist 20 to provide sufficient slack for the wearing thereover of gear such as a military web belt supporting a canteen, sidearm or the like. The shirt 12 may have short sleeves, medium sleeves, or long sleeves with fasteners such as buttons, snaps, hook and loop fasteners, or the like for securing in place a rolled-up sleeve. FIG. 6 shows an embodiment in which the shirt 12 has long sleeves 80 (while one sleeve is shown long it is to be understood that conventionally both sleeves are long), which can optionally have a sleeve end 82 with a fastener 84 such as buttons, snaps, hook and loop fasteners, or the like for use when rolling the sleeve up. The fastener 84 on the sleeve end 82 can be attached or otherwise associated with a mating attachment fastener 86 on the upper portion of the sleeve. Alternatively, as shown in FIG. 7, the shirt can have sleeves that are removable using a zipper 88 or other removable fastener/retention device. In this manner, the long sleeve shirt 12 can be used as a short sleeve shirt when not in surgery or when not exposed to contaminants.

The long sleeve can have a cinching means 90, such as a hook and loop closure for adjustably conforming to the wearer's wrists. Alternatively, buttons, snaps, drawstring or the like, can be used for closure. Closure of the sleeve can reduce possible skin exposure to contaminants. Gloves can be fitted over or under the sleeve end 82. It will be understood by those skilled in the art that the shirt 12 can be provided by any means for substantially covering a wearer's upper body, including a blouse, jacket, jumpsuit, gown, robe, dress, or the like.

Figure 8:
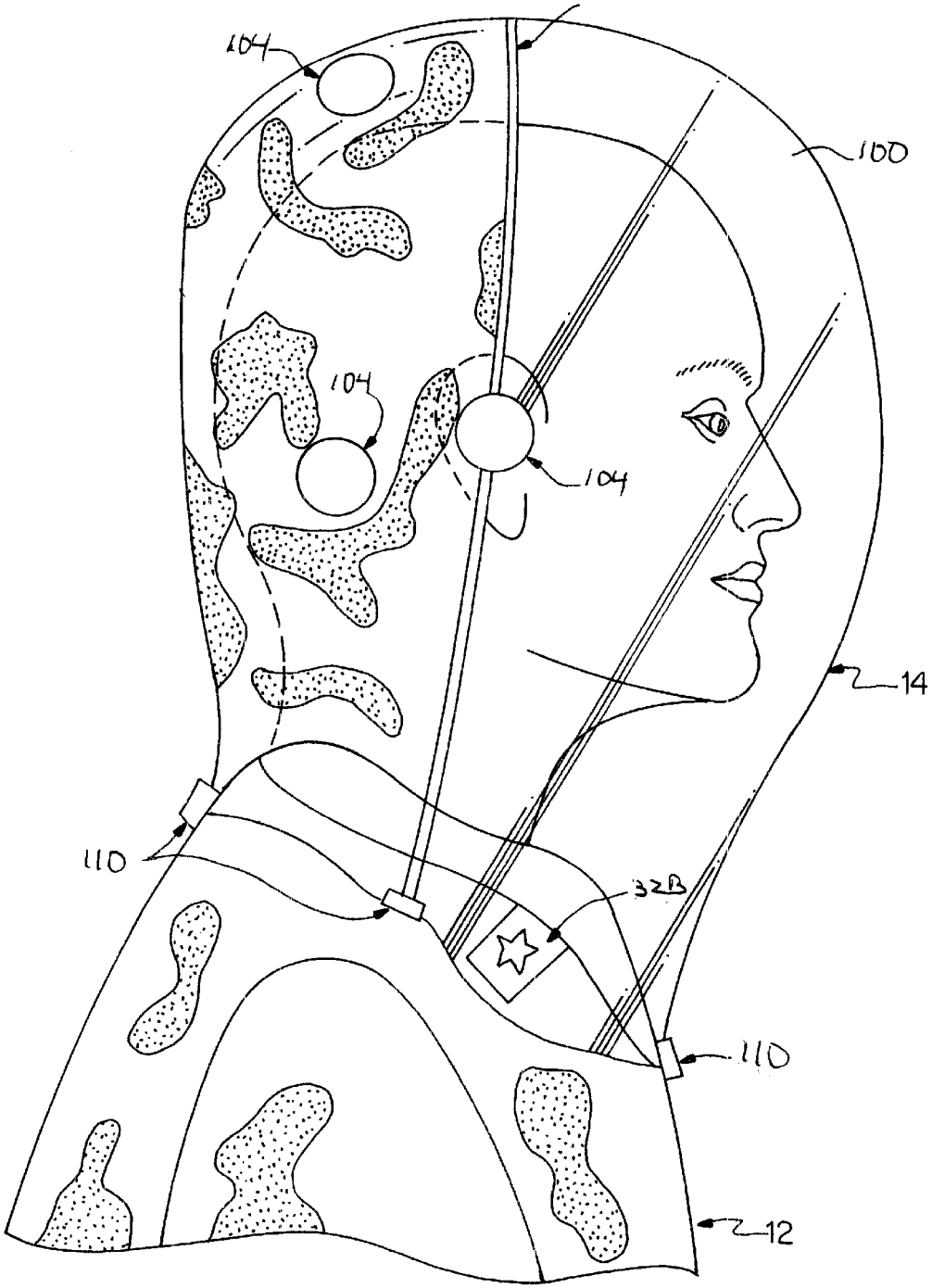
FIG. 8 is a side view of the hood of the embodiment.

Referring now to FIG. 8, there is illustrated a hood 14 which substantially covers the wearer's head. The hood 14 has a face shield 100 made of a generally translucent and flexible material such as clear plastic or another material known to those skilled in the art. The face shield 100 protects the wearer's face from blood and other fluid splatter while providing healthcare treatment. A non-front portion 102 of the hood 14, such as a side, rear, or top, may be made of the same material as the pants 10 and shirt 12 or of disposable material such a paper or the like. The non-front portion 102 has at least one opening 104 defined therein to permit airflow into and out of the hood 14 for preventing fogging of the face shield 100. For example, there may be provided two openings 104 generally adjacent the wearer's ears thereby permitting the insertion therethrough of the end ear pieces of a stethoscope for use by the wearer, and/or additional ventilation openings as may be desired. By providing a plurality of openings 104, each opening 104 can be made relatively smaller while allowing the same amount of airflow therethrough, thereby maintaining the integrity of the barnier by minimizing the likelihood of a fluid passing through the small openings 104 and contacting the user. The non-front location of the opening 104 reduces the possibility fluids penetrating the hood 14 from direct spattering or volatilizing of fluid, such arterial blood spray, vomit, or other body fluids. Optionally, the opening 104 can be covered with a material that is audio transparent or translucent to permit the use to hear through the material, while protecting the user from contamination. Additionally, the hood 100 may have a brace 106 for supporting the hood 14 away from the wearer's face. It will be understood by those skilled in the art that the hood 14 can be provided by other means for substantially covering a person's head, including a cap with a roll-down face shield, a cap with a flip-down face shield, a cap with a snap-on face shield, or the like. Also, it is contemplated that accessories, such as but not limited to, a sun visor, radiation filter, magnifier, camera, microphone light source and the like, can be removably, rotatably or fixedly associated with the hood 14.

The hood 14 provides additional benefits by acting as a barrier as to prevent insects, flies, and other disease carrying pests from contacting and possibly infecting the user of the garment system. This is particularly beneficial in environments or situations where insects, flies, and the like proliferate. For example, on emergency relief missions after a hurricane, in hostile climates such as the tropics, or when military or other units recover decayed remains or provide healthcare in the field in the vicinity of decaying human and animal bodies which attract insects, flies, and the like.

There may also be provided at least one coupling 110 associated with the shirt 12 for detachably connecting to a mating coupling 112 associated with the hood 14 to the shirt 12. The coupling 50 may be provided by hook and loop fasteners, snaps, buttons, zipper, or other means for detachably coupling materials together as are known to those skilled in the art. The hood 14 may be thus be detached from the shirt 12 and stored in one of the pockets when not in use.

The garment system 5 of the present invention may be worn as a uniform in the field and in combat situations while providing healthcare treatment and while not, in compliance with the requirements of organizations such as the military. The garments form a generally contiguous full body barrier protecting the wearer from exposure to infectious materials in body fluids, which fluids are often splattered in large quantities on healthcare providers in field and combat situations. The hood 14 may then be detached from the shirt 12 at the couplings 110 and 112, removed from the wearer's head, and restored in one of the pockets. The garments may be discarded after a single use, or the personal insignia 32 may be removed from the shirt 12 after use and a plurality of shirts 12, pants 10, and hoods 14 can be laundered in bulk and redistributed according to size requests from the healthcare providers without having to sort the garments by the providers' names.

The present invention can be advantageously use in field hospitals, such as in combat zones where triage and emergency surgery often occur. The present invention can also provide protection against certain airborne contaminants, particularly when the openings 104 are covered with some type of material. The present invention also can be adapted for use with an external air supply (such as by incorporating a connector in the back of the shirt 12 for connection to an air tank or pump), in which case the openings 104 can be modified to reduce exposure to the environment while allowing access to a stethoscope or other device by making the opening covered by a flap (not shown). Creating a positive air pressure flow within the garment system may reduce infiltration of airborne contaminants. The present invention may advantageously used in such circumstances where full body one-piece, air-supplied suits are impracticable, cumbersome and expensive. During surgery, such suits are often too limiting to allow a practitioner to have optimum flexibility to work on a wounded patient. The garment system of the present invention can be used in such environments. Additionally, full suits are not easily cleaned or reused after exposure to contaminants without appropriate facilities for decontamination, whereas the present invention can be laundered with conventional military garments.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A barrier garment system, comprising:

a) pants having a waist end;

b) a shirt having i) a first pocket having a flap and an attachment means for removably attaching a badge or other item to said pocket, ii) at least one insignia removably attached to said shirt, iii) a collar, said collar having at least one coupling associated therewith; and, c) a hood having i) a generally translucent face shield, ii) at least one opening defined in said hood, and, iii) at least one coupling for detachably connecting said hood to said collar coupling, wherein said pants, shirt, and hood form a generally contiguous barrier protecting said wearer from infectious fluids.

* * * * *